US007830266B2

(12) United States Patent
Nakagoshi et al.

(10) Patent No.: US 7,830,266 B2
(45) Date of Patent: Nov. 9, 2010

(54) DROWSY STATE DETERMINATION DEVICE AND METHOD

(75) Inventors: Akira Nakagoshi, Toyota (JP); Kenji Kimura, Toyota (JP); Bertin Rodolphe Okombi-Diba, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 319 days.

(21) Appl. No.: 12/178,988

(22) Filed: Jul. 24, 2008

(65) Prior Publication Data

US 2009/0027212 A1 Jan. 29, 2009

(30) Foreign Application Priority Data

Jul. 26, 2007 (JP) ..... 2007-194834

(51) Int. Cl.
*G08B 23/00* (2006.01)

(52) U.S. Cl. ..... 340/576; 340/575

(58) Field of Classification Search ..... 340/576, 340/575

See application file for complete search history.

(56) References Cited

U.S. PATENT DOCUMENTS 4,953,111 A * 8/1990 Yamamoto et al. ..... 340/575
6,717,518 B1 * 4/2004 Pirim et al. ..... 340/576
7,202,792 B2 * 4/2007 Zhang et al. ..... 340/575

FOREIGN PATENT DOCUMENTS

| | | |
|---|---|---|
| JP | 6-219181 | 8/1994 |
| JP | 7-156682 | 6/1995 |
| JP | 8-332871 | 12/1996 |
| JP | 9-277849 | 10/1997 |
| JP | 2002-29279 | 1/2002 |
| JP | 2002-279410 | 9/2002 |
| JP | 2007-61484 | 3/2007 |

* cited by examiner

*Primary Examiner*—George A Bugg
*Assistant Examiner*—Naomi Small
(74) *Attorney, Agent, or Firm*—Oblon, Spivak, McClelland, Maier & Neustadt, L.L.P.

(57) ABSTRACT

A blink detection section generates an eye-closure signal indicating the duration of a period for which the driver closes his/her eyes. An eye-closure count section calculates the respective occurrence frequencies of single eye closures in a prescribed measurement period for a first eye-closure period threshold and a second eye-closure period threshold, based on the eye-closure signal and the respective eye-closure period thresholds. A drowsy state determination section compares the respective occurrence frequencies with the first eye-closure frequency threshold and the second eye-closure frequency threshold to determine which of the drowsiness levels corresponding to the respective thresholds the drowsiness level of the driver is at.

3 Claims, 4 Drawing Sheets

DROWSY STATE DETERMINATION DEVICE AND METHOD

INCORPORATION BY REFERENCE

The disclosure of Japanese Patent Application No. 2007-194834 filed on Jul. 26, 2007, including the specification, drawings and abstract is incorporated herein by reference in its entirety.

BACKGROUND OF THE INVENTION

1. Field of Invention

The present invention relates to a drowsy state determination device and method, and more specifically to a device and method that determines the drowsiness level of the driver of a mobile unit such as an automobile.

2. Description of Related Art

In recent years, there have been proposed devices that determine the drowsiness level of the driver of a mobile unit such as an automobile (see Japanese Patent Application Publication No. 6-219181 (JP-A-6-219181), for example). The doze detector disclosed in JP-A-6-219181 accumulates the duration of blinks (hereinafter referred to as "eye closures") of the driver of a prescribed time or more over a fixed period. The doze detector determines that the driver is dozing when the accumulated duration exceeds a predetermined threshold.

The above doze detector compares the accumulated duration of all the eye closures that last for the prescribed time or more over the fixed period with the threshold to determine whether the driver is awakened or dozing. The drowsiness level of the driver, however, cannot be simply differentiated into two states, namely awakened and dozing. Rather, the drowsiness of the driver can be differentiated into more than two levels including, for example, slight drowsiness and heavy drowsiness. That is, the drowsiness level of the driver can be differentiated into more than two drowsiness levels ranging from awakened to dozing, which corresponds to the heaviest drowsiness. The duration of eye closures of the driver vary greatly among different drowsiness levels.

Therefore, the doze detector may erroneously determine that the driver is dozing, even in the case where the driver is actually awakened, once the driver closes his/her eyes for a period indicated by the threshold or more, even if the threshold for comparison with the accumulated duration is set optimally. Such an erroneous determination can be made when, for example, the driver is so dazzled by a bright light in the surroundings, such as a backlight, that he/she narrows or closes his/her eyes. In addition, since the drowsiness level of the driver is simply differentiated into two levels, namely awakened and dozing, the doze detector may erroneously determine that the driver is simply dozing, even in the case where the driver is actually feeling slight drowsiness or heavy drowsiness. That is, the above doze detector has a problem of erroneously determining the drowsiness level of the driver.

SUMMARY OF THE INVENTION

The present invention provides a drowsy state determination device and method that can prevent an erroneous determination of the drowsiness level of the driver by determining the drowsiness level of the driver based on a first threshold for differentiating eye closures that occur during a fixed period and that last for a prescribed period or more, and a second threshold for differentiating the occurrence frequency of the eye closures that last for the period indicated by the first threshold or more.

A first aspect of the present invention is directed to a drowsy state determination device that determines a drowsy state of a driver of a vehicle. The drowsy state determination device includes an eye-closure detection device that detects a closure degree of an eye of the driver to generate an eye-closure signal indicating an eye-closure period from an eye closure to a subsequent eye opening of the driver; a storage device that stores a first threshold in accordance with a prescribed drowsiness level, a second threshold corresponding to the first threshold, and the eye-closure period that is indicated by the eye-closure signal, that occurs during a prescribed measurement period, for which the eye-closure signal is measured, and that lasts for a period indicated by the first threshold or more; and a controller that calculates an eye-closure value representing the duration of a time for which the driver closes his/her eye during the measurement time based on the eye-closure period stored in the storage device to determine that a drowsiness level of the driver is at the prescribed drowsiness level or more when the eye-closure value is at the second threshold or more.

The storage device may store a plurality first thresholds and a plurality of second thresholds corresponding to the respective first thresholds for a plurality of drowsiness levels, and store the eye-closure period using the first threshold for each corresponding drowsiness level for the plurality of drowsiness levels. The controller may calculate the eye-closure value based on the stored eye-closure period for the plurality of drowsiness levels, determine whether or not the eye-closure value is at the second threshold or more for the plurality of drowsiness levels, and determine the highest drowsiness level at which the determination result is positive as the drowsiness level of the driver.

The controller may calculate the eye-closure value by accumulating an integer portion of a product obtained by dividing each eye-closure period stored in the storage device by the first threshold used to store that eye-closure period.

The controller may decrease the first threshold stored in the storage device according to a traveling speed of the vehicle.

The controller may decrease the first threshold stored in the storage device according to the duration of a continuous traveling time of the vehicle.

A second aspect of the present invention is directed to a drowsy state determination device that determines a drowsy state of a driver of a vehicle. The drowsy state determination device includes: a detection device that detects an eye-closure period from an eye closure to a subsequent eye opening of the driver; and a controller that calculates an eye-closure value representing at least one of a number of eye-closure periods that are detected during a prescribed measurement period and that last for a period indicated by a first threshold or more, and a cumulative eye-closure period obtained by accumulating eye-closure periods that last for the period indicated by the first threshold or more detected over the predetermined measurement period, to determine a drowsiness level of the driver based on comparison between the eye-closure value and a second threshold corresponding to the first threshold.

A third aspect of the present invention is directed to a method for determining a drowsy state of a driver of a vehicle. The method includes: a step of detecting a closure degree of an eye of the driver to detect an eye-closure period from an eye closure to a subsequent eye opening of the driver; a step of storing the eye-closure period that occurs during a prescribed measurement period and that lasts for a period indicated by a first threshold or more; a step of calculating an eye-closure value representing the duration of a time for which the driver closes his/her eye during the measurement time based on the stored eye-closure period; and a step of determining that a drowsiness level of the driver is at the prescribed drowsiness level or more when the eye-closure value is at a second threshold corresponding to the first threshold or more.

A fourth aspect of the present invention is directed to a method for determining a drowsy state of a driver of a vehicle. The method includes: a step of detecting an eye-closure period from an eye closure to a subsequent eye opening of the driver; a step of calculating an eye-closure value representing at least one of a number of eye-closure periods that are detected during a prescribed measurement period and that last for a period indicated by a first threshold or more, and a cumulative eye-closure period obtained by accumulating eye-closure periods that last for the period indicated by the first threshold or more detected over the predetermined measurement period; and a step of determining a drowsiness level of the driver based on comparison between the eye-closure value and a second threshold corresponding to the first threshold.

The present invention can provide a drowsy state determination device and method that can prevent an erroneous determination of the drowsiness level of the driver.

BRIEF DESCRIPTION OF THE DRAWINGS

The foregoing and further objects, features and advantages of the invention will become apparent from the following description of exemplary embodiments with reference to the accompanying drawings, wherein like numerals are used to represent like elements and wherein.

DETAILED DESCRIPTION OF EMBODIMENTS

First Embodiment

Figure 1A:
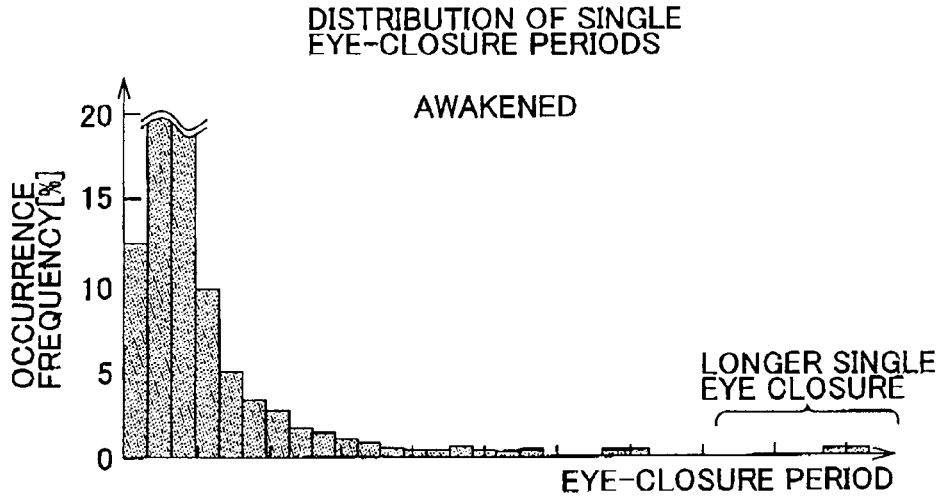
FIGS. 1A to 1C each show an example of the distribution of eye-closure periods.
Figure 1B:
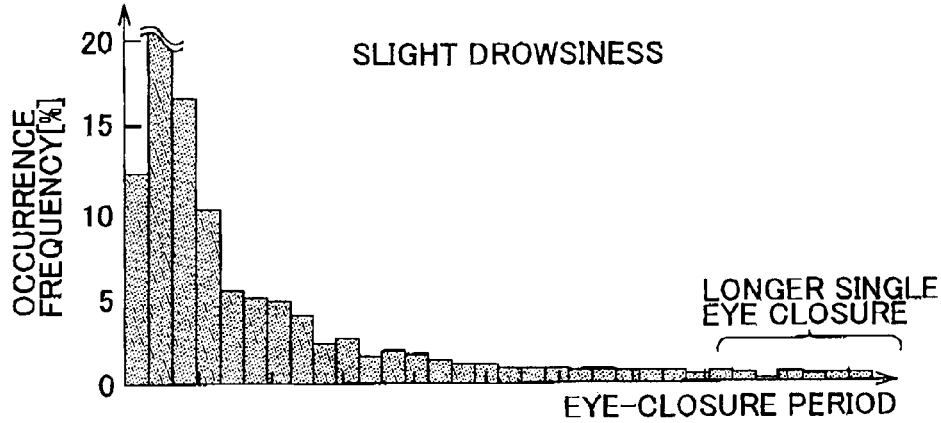
Figure 1C:
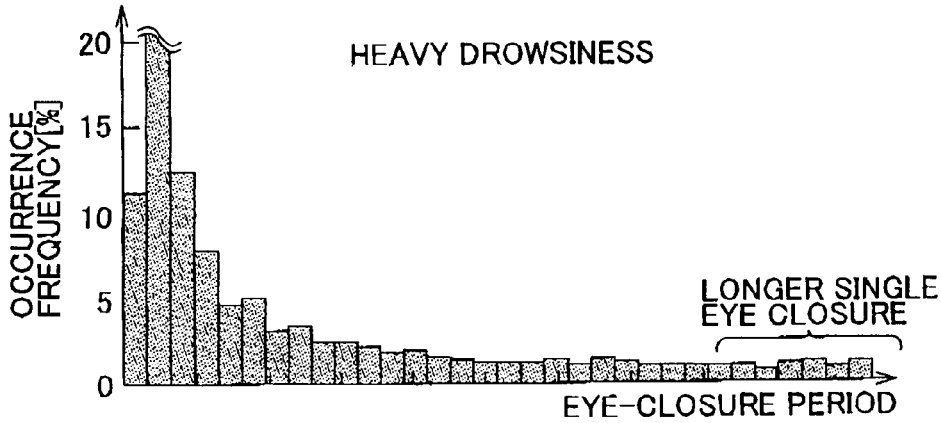

FIGS. 1A to 1C are histograms representing the distribution of a plurality of durationpecific eye closures of the driver that occur during a prescribed time for respective drowsiness levels of the driver. In the histograms of FIGS. 1A to 1C, the horizontal axis represents the duration of respective eye closures (hereinafter each eye closure is referred to as "single eye closure"), and the vertical axis represents the occurrence frequency of single eye closures of each duration. The histogram of FIG. 1A represents the case where the driver is awakened. The histogram of FIG. 1B represents the case where the driver is feeling slight drowsiness. The histogram of FIG. 1C represents the case where the driver is feeling heavy drowsiness. In this embodiment, the "drowsiness level" is higher (heavier) as the driver is drowsier. In the description of this embodiment, the drowsiness level of the driver is determined from three levels, namely awakened, slightly drowsy, and heavily drowsy, by way of example. In this embodiment, the term "awakened" refers to the state where the driver is not feeling drowsy at all.

As is clear from comparison of FIGS. 1A to 1C, the occurrence frequency of longer single eye closures increases as the drowsiness level of the driver is higher. Thus, the drowsiness level of the driver can be determined by determining a threshold for extracting only single eye closures that last for a prescribed period or more, and a threshold for extracting only an occurrence frequency of a prescribed value or more from the occurrence frequencies of the single eye closures that last for a period indicated by the threshold or more, for each of the drowsiness levels to be determined. More specifically, a first eye-closure period threshold Td1 is set, and an occurrence frequency N1 of single eye closures that occur during a predetermined measurement period and that last for a period indicated by the first eye-closure period threshold Td1 or more is calculated. In addition, a first eye-closure frequency threshold Tn1 is set, and the drowsiness level of the driver can be determined to be slight when the occurrence frequency N1 is at the first eye-closure frequency threshold Tn1 or more. Further, a second eye-closure period threshold Td2 is set, and an occurrence frequency N2 of single eye closures that occur during a prescribed period and that last for a period indicated by the second eye-closure period threshold Td2 or more is calculated. In addition, a second eye-closure frequency threshold Tn2 is set, and the drowsiness level of the driver can be determined to be heavy when the occurrence frequency N2 is at the second eye-closure frequency threshold Tn2 or more. The first eye-closure frequency threshold Tn1 is determined experimentally based on the first eye-closure period threshold Td1, a predetermined measurement period, for which single eye closures and single eye-closure periods are measured, and a calculation method for the occurrence frequency of single eye closures. The second eye-closure frequency threshold Tn2 is determined experimentally based on the second eye-closure period threshold Td2, the predetermined measurement period, and the calculation method for the occurrence frequency of single eye closures. Hereinafter, the first eye-closure period threshold Td1 and the second eye-closure period threshold Td2 will be described more specifically.

Tn1=f(Td1), Tn2=f(Td2), and the eye-closure period threshold Td is a function of the eye-closure frequency threshold Tn. The eye-closure frequency threshold Tn is selected optimally in accordance to the eye-closure period threshold Td. Thus, there is a clear relationship between the eye-closure period threshold Td and the eye-closure frequency threshold Tn. The first and second eye-closure period threshold (threshold duration) Td1 and Td2 are found experimentally through measurements on several subjects exhibiting various eye closure patterns. Based on these measurements, it is possible to calculate the required thresholds for the number of number of eye closures corresponding to different level of drowsiness, the first eye-closure frequency threshold Tn1 and the second eye-closure frequency threshold Tn2:

threshold duration Td1 yields the first eye-closure frequency threshold (threshold count) Tn1 for "slightly drowsy" drivers;

threshold duration Td2 yields the second eye-closure frequency threshold (threshold count) Tn2 for "heavily (strongly) drowsy" drivers.

The method to determine the drowsiness level of the driver has been described above. According to this method, it is possible to not only make a binary determination of whether or not the driver is drowsy, but also differentiate the drowsiness level of the driver into more than two levels including, for example, slightly drowsy and heavily drowsy. The method to calculate the occurrence frequencies N1 and N2 will be discussed later.

Figures 2A, 2B:
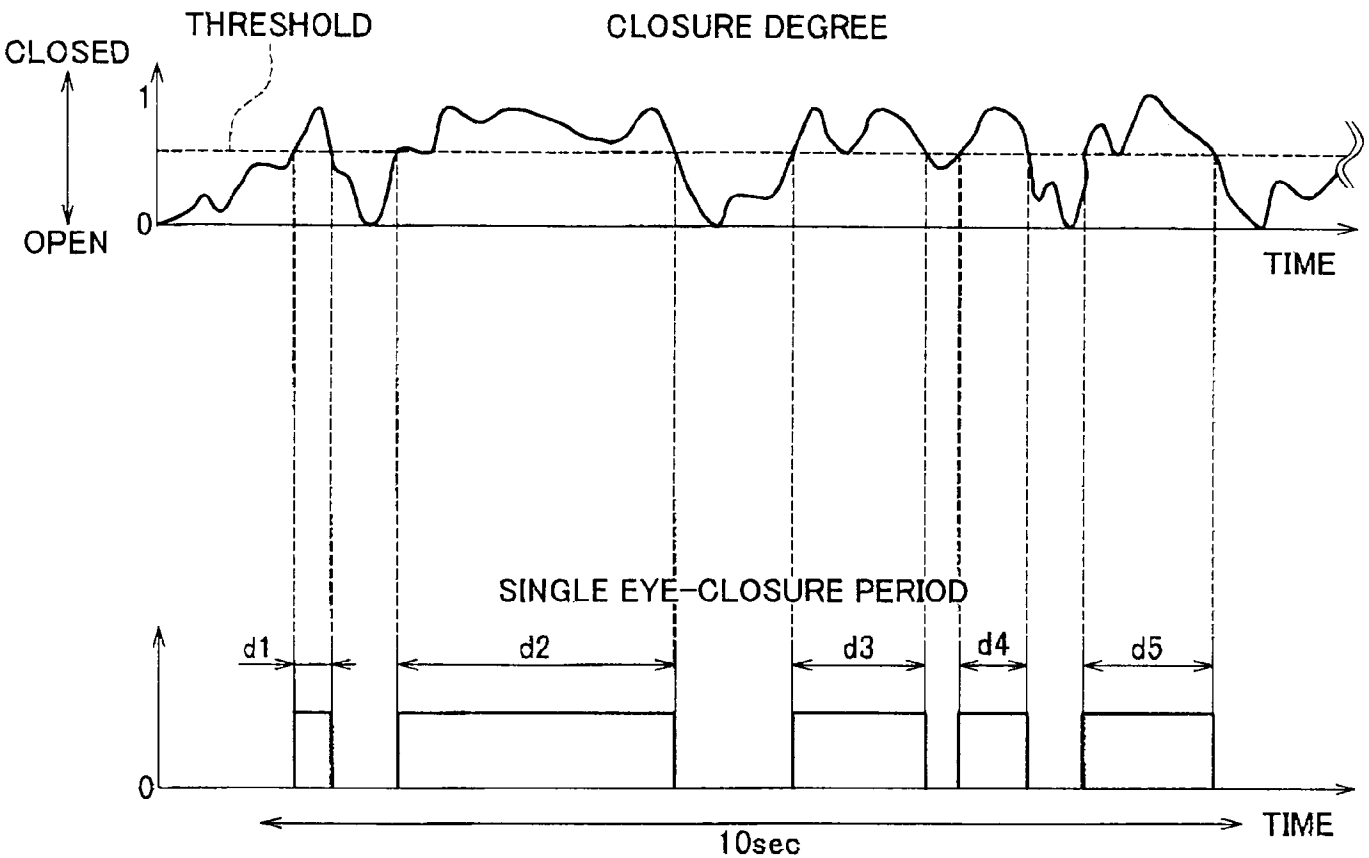
FIGS. 2A and 2B respectively illustrate the closure degree and single eye-closure periods.

A description will next be made of the method to measure single eye closures and single eye-closure periods in accordance with the embodiment of the present invention. FIG. 2A shows the closure degree of the eyelids of the driver in accordance with the lapse of time. In FIG. 2A, the horizontal axis represents the time, and the vertical axis represents the closure degree of the eyelids of the driver. In this embodiment, the term "single eye closure" refers to each eye closure with a closure degree of the threshold shown in FIG. 2A or more. FIG. 2B shows single eye-closure periods determined based on the closure degree shown in FIG. 2A. Reference symbols "d1" to "d5" in FIG. 2B represent the respective duration of the single eye-closure periods. In this embodiment, as shown in FIG. 2B, the duration of a single eye-closure period starts when the closure degree of the eyelids of the driver becomes the threshold shown in FIG. 2A or more, and ends when the closure degree of the eyelids of the driver becomes less than the threshold shown in FIG. 2A the next time after the start of the single eye-closure period, in a prescribed measurement period. In other words, the driver is determined to close his/her eyes when the closure degree of the eyelids of the driver becomes the threshold shown in FIG. 2A or more, and determined to open his/her eyes when the closure degree of the eyelids of the driver becomes less than the threshold shown in FIG. 2A the next time. The method to measure single eye closures and single eye-closure periods in accordance with this embodiment has been described above. The threshold shown in FIG. 2A may be any predetermined value. The method to detect the closure degree of the eyelids of the driver will be discussed later.

A detailed description will next be made of the method to calculate the occurrence frequency N1 or N2 discussed above with reference to FIG. 2B. In order to calculate the occurrence frequency, first, the periods d1 to d5 shown in FIG. 2B are each compared with the first eye-closure period threshold Td1 discussed above to extract periods that last for a period indicated by the first eye-closure period threshold Td1 or more. Here, it is assumed that the single eye-closure periods d2, d3, and d5 last for a period indicated by the first eye-closure period threshold Td1 or more. Upon completion of the extraction of the periods that last for a period indicated by the first eye-closure period threshold Td1 or more, then, the extracted periods are each divided by the threshold used to extract those periods (here, the first eye-closure period threshold Td1), and the integers obtained by dropping the fractional portion of the products, that is, the integer portions of the products, are added to obtain the occurrence frequency N1. That is, a long single eye-closure period can result in an occurrence frequency of 2 or more. Rather than dividing the single eye-closure periods d1 to d5 by the first eye-closure period threshold Td1, the number of single eye-closure periods that last for a period indicated by the first eye-closure period threshold Td1 or more may simply be used as the occurrence frequency N1. As an alternative to dividing the single eye-closure periods d1 to d5 by the first eye-closure period threshold Td1, the single eye-closure periods that last for a period indicated by the first eye-closure period threshold Td1 or more may simply be added to obtain the occurrence frequency N1. However, the method, in which the occurrence frequency N1 is obtained by summing the integer portions of the values obtained by dividing the extracted periods by the first eye-closure period threshold Td1, has the following advantage.

Two related concepts are embedded in the drowsiness index in this embodiment, namely eye-closure period threshold Td and the eye-closure frequency threshold Tn. The eye-closure period threshold Td embodies the duration of eye closures representing either "slight drowsiness" or "heavy (strong) drowsiness". On the other hand, the eye-closure frequency threshold Tn embodies the total number of eye closures with duration greater than eye-closure period threshold Td. However, eye closure count as represented in this embodiment greatly differs from what is usually referred in that of JP-A-6-219181.

Here, a single count represents the amount by which the duration of one eye closure measure to the eye-closure period threshold (preset duration threshold) Td. For example, if Td1=0.7 sec, and d1=1.5 sec, then N1=2; and if Td2=2.1 sec, and d2=4.3 sec, then N2=2. This way, even when there are only few long eye closures, this index would detect drowsiness by yielding a higher value of N compared to a conventional count of eye closures such as JP-A-6-219181. In other words, the occurrence frequency N as index represents not only the duration threshold (Td1 or Td2), but also a count indicating its length.

Another advantage of the calculation method in this embodiment is that drowsiness detection indices (the first and second eye-closure frequency threshold Tn1 and Tn2) are not much influenced by fluctuations in the measurement of the duration of eye closure dn (d1 to d5). The result is a very robust drowsiness detection method. In JP-A-6-219181, any fluctuation in eye closure duration measurements would yield different results.

The occurrence frequency N2 can be calculated in the same way as the occurrence frequency N1, based on the second eye-closure period threshold Td2.

The relationship between the eye-closure period threshold Td and the eye-closure frequency threshold Tn could be expressed as follows:

$$N21=INT(d2/Td1)$$

$$N31=INT(d3/Td1)$$

$$N51=INT(d5/Td1)$$

wherein INT is INTEGER function.

$$N1=N21+N31+N51$$

If the occurrence frequency N1 is equal to or exceeds the first eye-closure frequency threshold Tn1 and the occurrence frequency N1 is below the second eye-closure frequency threshold Tn2 (N1≧Tn1 and N1<Tn2), it is determined that the driver feels slightly drowsy.

$$N22=INT(d2/Td2)$$

$$N2=N22$$

If the occurrence frequency N2 is equal to or exceeds the second eye-closure frequency threshold Tn2 (N2≧Tn2), it is determined that the driver feels very drowsy.

The method to calculate the occurrence frequency N1 or N2 has been described above. The term "occurrence frequency" is an index of how many times an eye-closure period that lasts for a period indicated by an eye-closure period threshold or more occurs during the measurement period discussed above. The occurrence frequencies N1 and N2 in this embodiment can be considered as the eye-closure value of the present invention.

Figure 3:
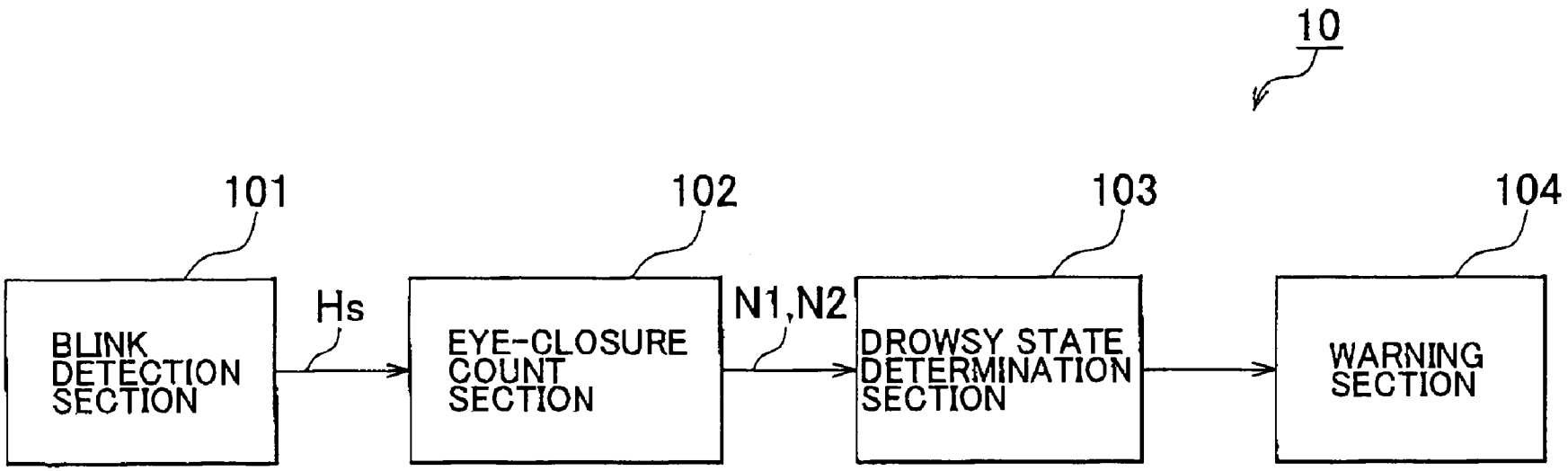
FIG. 3 shows the configuration of a warning device including a drowsy state determination device in accordance with a first embodiment.

A description will next be made of the configuration for issuing a warning according to the drowsiness level of the driver using a drowsy state determination device which executes the method for determining the drowsiness level of the driver discussed above, and of the operation of respective components. FIG. 3 is a block diagram showing the schematic configuration of a drowsy state determination device 10 in accordance with the first embodiment. The drowsy state determination device 10 includes a blink detection section 101, an eye-closure count section 102, a drowsy state determination section 103, and a warning section 104.

The blink detection section 101 detects the closure degree of the eyelids of the driver to generate an eye-closure signal Hs each representing the duration of the single eye-closure period discussed above. Here, a description will be made of an example of the method to detect the closure degree of the eyelids of the driver. In the method, an image of the face of the driver captured while irradiated with light of a wavelength in the infrared region is subjected to image processing to detect a blink. More specifically, the boundary between the upper eyelid and the eyeball (hereafter referred to as "upper eyelid boundary") and the boundary between the lower eyelid and the eye ball (hereinafter referred to as "lower eyelid boundary") are each extracted from the captured image by image processing. Then, the distance between the peak of the extracted upper eyelid boundary and the peak of the extracted lower eyelid boundary (the distance between the upper eyelid boundary and the lower eyelid boundary at its longest) is measured as the closure degree. Then, the blink detection section 101 generates an eye-closure signal Hs each representing the duration of the single eye-closure period shown in FIG. 2B when the closure degree is at the threshold shown in FIG. 2A or more, based on the detection results of the closure degree of the eyelids of the driver. It should be understood that the method for the blink detection section 101 to detect the closure degree of the eyelids of the driver is not limited to that discussed above and may be any method by which the eye-closure signal Hs discussed above can be generated.

In the method to detect the closure degree of the eyelid of the driver discussed above, an infrared camera is used to capture an image of the face of the driver. The amount of light incident on the infrared camera, however, varies with the time and so forth. During daytime, for example, the amount of light incident on the infrared camera increases. During nighttime, in contrast, the amount of light incident on the infrared camera reduces. When the amount of light incident is excessively large relative to the sensitivity of the infrared camera, the obtained image whites out. Meanwhile, when the amount of light incident is excessively small relative to the sensitivity of the infrared camera, the obtained image blacks out. Therefore, the closure degree can be accurately detected by controlling the amount of light incident on the infrared camera that captures an image of the face of the driver. Examples of the method to control the amount of light incident on the infrared camera include providing a light filter at the light-incident surface of the infrared camera to restrict the amount of light incident thereon. More specifically, different types of light filters are used according to the amount of light incident on the infrared camera, the time at which the infrared camera is operating, or whether the driver turns on and off the headlight, for example.

The eye-closure count section 102 has preset therein a measurement period Wd, the first eye-closure period threshold Td1, and the second eye-closure period threshold Td2. The eye-closure count section 102 counts the occurrence frequencies N1 and N2 for every measurement period Wd in the method discussed above, based on the eye-closure signal Hs, the first eye-closure period threshold Td1, and the second eye-closure period threshold Td2.

The drowsy state determination section 103 has preset therein the first eye-closure frequency threshold Tn1 and the second eye-closure frequency threshold Tn2. The drowsy state determination section 103 acquires the occurrence frequencies N1 and N2 calculated by the eye-closure count section 102. Then, the drowsy state determination section 103 compares the occurrence frequency N1 with the first eye-closure frequency threshold Tn1, and the occurrence frequency N2 with the second eye-closure frequency threshold Tn2. Then, the drowsy state determination section 103 determines the drowsiness level of the driver and the warning type based on the comparison results to command the warning section 104 to issue a warning in accordance with the drowsiness level of the driver.

The warning section 104 issues a warning to the driver according to the command of the drowsy state determination section 103. The warning section 104 issues a warning of one or more types according to the drowsiness level of the driver. The type of a warning to be issued by the warning section 104 is determined according to the strength of a stimulus to be given to the driver, for example. Examples of the method for the warning section 104 to issue a warning include producing a warning sound from a speaker preliminarily provided in a mobile unit such as an automobile, and displaying a warning image on the display for a car navigation system. The configuration for issuing a warning according to the drowsiness level of the driver and the operation of respective components have been described above.

Figure 4:
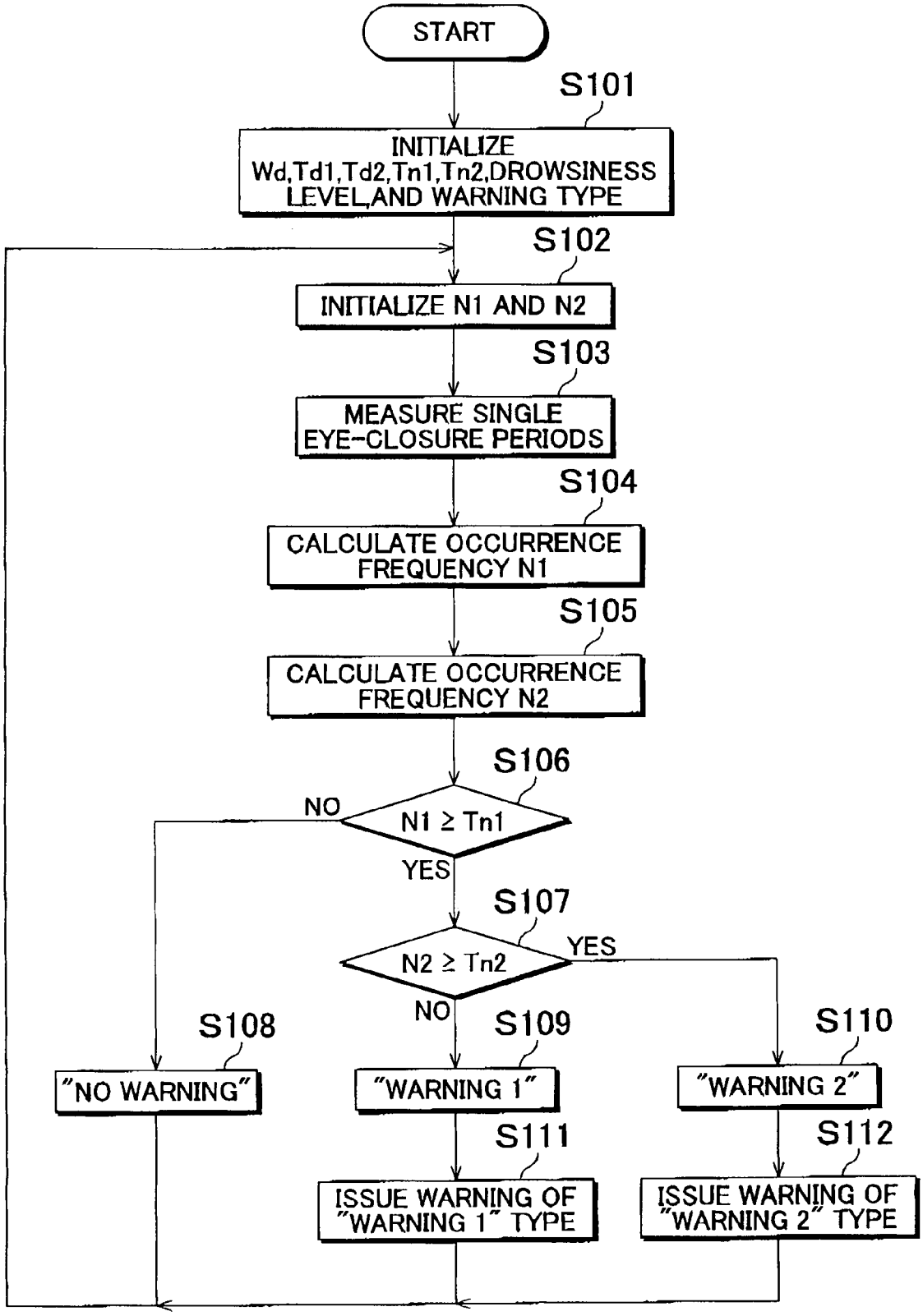
FIG. 4 is a flowchart showing the process performed by the warning device including the drowsy state determination device in accordance with the first embodiment.

Referring to the flowchart of FIG. 4, a more detailed description will next be made of the process executed by the drowsy state determination device 10 in accordance with this embodiment, from determining the drowsiness level of the driver to issuing a warning.

In step S101, the eye-closure count section 102 initializes the measurement period Wd, the first eye-closure period threshold Td1, and the second eye-closure period threshold Td2, or sets them according to the drowsiness level to be determined. Also in step S101, the drowsy state determination section 103 initializes the first eye-closure frequency threshold Tn1 and the second eye-closure frequency threshold Tn2, or sets them to values in accordance with the drowsiness level to be determined or the first eye-closure period threshold Td1 and the second eye-closure period threshold Td2 discussed above, respectively. Further in step S101, the drowsy state determination section 103 initializes the drowsiness level and the warning type, or sets the former to "awakened" and the latter to "no warning."

In step S102, the eye-closure count section 102 initializes the occurrence frequencies N1 and N2, or sets them to zero.

In step S103, the eye-closure count section 102 stores in the storage section 105 the respective duration of single eye-closure periods indicated by eye-closure signals Hs generated by the blink detection section 101 during the measurement period Wd. The storage section 105 further stores the first and second eye-closure period thresholds Td1 and Td2, the first and second eye-closure frequency thresholds Tn1 and Tn2, and single eye-closure periods determined to last for a period indicated by the first and second eye-closure period thresholds Td1 and Td2 or more.

In step S104, the eye-closure count section 102 calculates the occurrence frequency N1. More specifically, the eye-closure count section 102 calculates the occurrence frequency N1 using the method to calculate the occurrence frequency discussed above, based on the results of comparison between the respective duration of the single eye-closure periods stored in S103 and the first eye-closure period threshold Td1.

In step S105, the eye-closure count section 102 calculates the occurrence frequency N2. More specifically, the eye-closure count section 102 calculates the occurrence frequency N2 using the method to calculate the occurrence frequency discussed above, based on the results of comparison between the respective duration of the single eye-closure periods stored in S103 and the second eye-closure period threshold Td2.

In step S106, the drowsy state determination section 103 acquires the occurrence frequency N1 counted by the eye-closure count section 102 to determine whether or not the acquired occurrence frequency N1 is at the first eye-closure frequency threshold Tn1 or more. If the drowsy state determination section 103 determines in step S106 that the occurrence frequency N1 is not at the first eye-closure frequency threshold Tn1 or more, the process proceeds to step S108. On the other hand, if the drowsy state determination section 103 determines in step S106 that the occurrence frequency N1 is at the first eye-closure frequency threshold Tn1 or more, the process proceeds to step S107.

In step S107, the drowsy state determination section 103 acquires the occurrence frequency N2 calculated by the eye-closure count section 102 to determine whether or not the acquired occurrence frequency N2 is at the second eye-closure frequency threshold Tn2 or more. If the drowsy state determination section 103 determines in step S107 that the occurrence frequency N2 is not at the second eye-closure frequency threshold Tn2 or more, the process proceeds to step S109. On the other hand, if the drowsy state determination section 103 determines in step S107 that the occurrence frequency N2 is at the second eye-closure frequency threshold Tn2 or more, the process proceeds to step S110.

In step S108, the drowsy state determination section 103 sets the warning type to "no warning." When the drowsy state determination section 103 completes the process in step S108, the process returns to step S102.

In step S109, the drowsy state determination section 103 commands the warning section 104 to issue a warning of the "warning 1" type. When the drowsy state determination section 103 completes the process in step S109, the process proceeds to step S111.

In step S110, the drowsy state determination section 103 commands the warning section 104 to issue a warning of the "warning 2" type. When the drowsy state determination section 103 completes the process in step S110, the process proceeds to step S112.

In step S111, the warning section 104 issues a warning of the "warning 1" type. When the warning section 104 completes the process in step S111, the process returns to step S102.

In step S112, the warning section 104 issues a warning of the "warning 2" type. When the warning section 104 completes the process in step S112, the process returns to step S102.

The process to be performed by the drowsy state determination device 10 in accordance with this embodiment has been described in detail above. By the drowsy state determination device 10 in accordance with this embodiment performing the process shown in the flowchart of FIG. 4, it is possible to prevent an erroneous determination of the drowsiness level of the driver, by determining the drowsiness level of the driver based on a threshold (eye-closure period threshold) for extracting only single eye-closure periods that occur during a prescribed measurement period and that last longer than a prescribed period, and based on a threshold (eye-closure frequency threshold) for extracting only an occurrence frequency of a prescribed value or more from the occurrence frequencies of the single eye-closure periods that occur while the vehicle is traveling and that last for a period indicated by the eye-closure period threshold or more. The drowsy state determination device 10 can issue a warning that gives a stimulus of an optimum strength in accordance with the drowsiness level of the driver, and therefore can prevent giving discomfort to the driver by issuing a warning of a strong stimulus even in the case where the drowsiness level of the driver is slight.

In the drowsy state determination device in accordance with this embodiment, two eye-closure period thresholds and two eye-closure frequency thresholds are set since the drowsiness level of the driver is differentiated into three levels, namely awakened, slightly drowsy, and heavily drowsy. It should be understood, however, that the drowsiness level of the driver may be differentiated not necessarily into three levels, but also into two or four or more levels, by the drowsy state determination device. Then, the eye-closure period threshold and the eye-closure frequency threshold may be predetermined in a number corresponding to the number of the drowsiness levels of the driver to be determined. Here, the respective thresholds are determined based on the correlation between the eye-closure period threshold and the eye-closure frequency threshold.

In this embodiment, when the eye-closure period threshold is increased, the occurrence frequency is decreased, and therefore the possibility that the driver is determined to be feeling drowsy (in this embodiment, the possibility that the driver is determined to be not awakened but slightly drowsy or heavily drowsy, for example) reduces, even if single eye closures of the driver that last for a longer single eye-closure period increase. In contrast, when the eye-closure period threshold is decreased, single eye closures of the driver that last for a shorter single eye-closure period are taken into account in calculating the occurrence frequency, and therefore the possibility that the driver is determined to be feeling drowsy increases. That is, varying the eye-closure period threshold means varying the sensitivity of the drowsy state determination device in accordance with this embodiment.

In the description of this embodiment, the eye-closure period threshold is a fixed value that does not vary while the drowsiness level of the driver is determined. However, the eye-closure period threshold may be varied according to the traveling speed of the vehicle on which the drowsy state determination device in accordance with this embodiment is mounted. Examples of the method to vary the eye-closure period threshold according to the traveling speed of the vehicle include increasing the eye-closure period threshold as the traveling speed of the vehicle becomes lower and decreasing the eye-closure period threshold as the traveling speed of the vehicle becomes higher. When the traveling speed of the vehicle is low, the occurrence frequency of single eye closures that last for a relatively long period occasionally increases, even if the driver is awakened. Thus, it is possible to more reliably prevent an erroneous determination of the drowsiness level of the driver while the drowsiness level of the driver is determined, irrespective of whether the traveling speed of the vehicle is low or high, by varying the eye-closure period threshold according to the traveling speed as discussed above.

In this embodiment, the eye-closure period threshold may be varied according to the continuous traveling time of the vehicle on which the drowsy state determination device in accordance with this embodiment is mounted. Examples of the method to vary the eye-closure period threshold according to the continuous traveling time of the vehicle include decreasing the eye-closure period threshold as the continuous traveling time of the vehicle becomes longer. The driver tends to feel more tired and more drowsy as he/she drives the vehicle for a longer time. Therefore, it is possible to both lower the possibility of erroneously determining that the driver is awakened even in the case where he/she is feeling drowsy, and more sensitively determine the drowsiness of the driver, by decreasing the eye-closure period threshold to increase the sensitivity of the drowsy state determination device.

In this embodiment, when the eye-closure frequency threshold is increased, the possibility that the driver is determined to be feeling drowsy (in this embodiment, the possibility that the driver is determined to be not awakened but slightly drowsy or heavily drowsy, for example) reduces, even if single eye closures of the driver that last for a longer single eye-closure period increase. In contrast, when the eye-closure frequency threshold is decreased, the possibility that the driver is determined to be feeling drowsy increases, even if the occurrence frequency of single eye closures of the driver that last for a longer single eye-closure period reduces. That is, varying the eye-closure frequency threshold means varying the sensitivity of the drowsy state determination device in accordance with this embodiment.

Thus, the eye-closure frequency threshold may be varied according to the traveling speed of the vehicle on which the drowsy state determination device in accordance with this embodiment is mounted. Examples of the method to vary the eye-closure frequency threshold according to the traveling speed of the vehicle include increasing the eye-closure frequency threshold when the vehicle is traveling on a local road while decreasing the eye-closure frequency threshold when the vehicle is traveling on a highway. When traveling on a local road or the like, the driver starts and stops the vehicle based on traffic lights, and thus the driving operation itself stimulates the driver. Therefore, when the vehicle is traveling on a local road, the driver does not tend to feel drowsy, and hence it is possible to lower the possibility that the driver is erroneously determined to be feeling drowsy, even in the case where he/she is awakened, by increasing the eye-closure frequency threshold to lower the sensitivity of the drowsy state determination device. On the other hand, when the vehicle is traveling on a highway, there are few traffic lights, based on which to start and stop the vehicle, or few intersections, at which to make right and left turns, and hence the driving operation is not as stimulating to the driver as when traveling on a local road. Therefore, when the vehicle is traveling on a highway, the driver tends to feel drowsy, and hence it is possible to lower the possibility that the driver is erroneously determined to be awakened, even in the case where he/she is drowsy, by decreasing the eye-closure frequency threshold to increase the sensitivity of the drowsy state determination device. The type of the road on which the vehicle is traveling (for example, a local road or a highway) may be directly determined based on information from a car navigation system, or determined based on the traveling speed of the vehicle. In the case where the type of the road on which the vehicle is traveling is determined based on the traveling speed of the vehicle, the legal speed limit which is determined for every type of road may also be taken into account.

The drowsiness level of the driver may be determined based on the number or the accumulated value of single eye-closure periods that last for a period between the first eye-closure period threshold Td1 and the second eye-closure period threshold Td2, and based on the number or the accumulated value of single eye-closure periods that last for a period indicated by the second eye-closure period threshold Td2 or more.

The present invention can provide a drowsy state determination device that can prevent an erroneous determination of the drowsiness level of the driver and that can be mounted on a vehicle such as an automobile, for example.

What is claimed is:

1. A drowsy state determination device that determines a drowsy state of a driver of a vehicle, comprising:

an eye-closure detection device that detects a closure degree of an eye of the driver to generate an eye-closure signal indicating an eye-closure period from an eye closure to a subsequent eye opening of the driver;

a first storage device that stores a first threshold in accordance with a drowsiness level to be determined;

an eye-closure period storage device that stores the eye-closure period that is indicated by the eye-closure signal, and that is equal to or above the first threshold as a result of comparison between the eye-closure period indicated by the eye-closure signal and the first threshold, in a prescribed measurement period for which the eye-closure signal is measured;

a calculation device that calculates an eye-closure value representing the duration of a time for which the driver closes his/her eyes during the measurement period based on the eye-closure period stored in the eye-closure period storage device;

a second storage device that stores a second threshold corresponding to the first threshold; and a drowsy state determination device that determines whether a drowsiness level of the driver is equal to or above the drowsiness level, based on whether the eye-closure value is equal to or above the second threshold as a result of comparison between the eye-closure value and the second threshold, wherein the first storage device stores a plurality of first thresholds for a plurality of drowsiness levels;

the second storage device stores a plurality of second thresholds corresponding to the respective first thresholds;

the eye-closure period storage device performs a process of storing the eye-closure period using the first threshold for each corresponding drowsiness level, for the plurality of drowsiness levels;

the calculation device performs a process of calculating the eye-closure value based on the stored eye-closure period, for the plurality of drowsiness levels;

the drowsy state determination device performs a process of determining whether or not the eye-closure value is equal to or above the second threshold, for the plurality of drowsiness levels, and determines the highest drowsiness level at which the determination result is positive, as the drowsiness level of the driver; and the calculation device calculates the eye-closure value by accumulating every integer portion of a quotient obtained by dividing each eye-closure period stored in the eye-closure period storage device by the first threshold used to store that eye-closure period.

2. The drowsy state determination device according to claim 1, further comprising:

a change device that decreases the first threshold stored in the first storage device according to a traveling speed of the vehicle.

3. The drowsy state determination device according to claim 1, further comprising:

a change device that decreases the first threshold stored in the first storage device according to the duration of a continuous traveling time of the vehicle.

* * * * *